United States Patent [19]

Klett

[11] 4,010,561

[45] Mar. 8, 1977

[54] EARTH SCRAPER WITH ROUTER BIT

[75] Inventor: Gene R. Klett, Joliet, Ill.

[73] Assignee: Caterpillar Tractor Co., Peoria, Ill.

[22] Filed: Apr. 21, 1975

[21] Appl. No.: 569,915

[52] U.S. Cl. ..... 37/141 T; 37/129; 37/DIG. 12; 172/780; 172/737; 172/783

[51] Int. Cl.[2] ..... E02F 9/00; A01B 23/02

[58] Field of Search ..... 172/780, 737, 783; 37/DIG. 12, 129, 141 R, DIG. 13, DIG. 14, 141 T

[56] References Cited

UNITED STATES PATENTS

| | | | |
|---|---|---|---|
| 1,034,546 | 8/1912 | Wells | 172/737 |
| 2,593,880 | 4/1952 | Heavilin | 172/780 |
| 2,628,848 | 2/1953 | Isaac | 172/780 X |
| 3,014,292 | 12/1961 | Fisher | 37/129 |
| 3,127,689 | 4/1964 | Hopkins | 172/783 X |

*Primary Examiner*—George J. Marlo
*Attorney, Agent, or Firm*—Wegner, Stellman, McCord, Wiles & Wood

[57] ABSTRACT

In an earthmoving scraper, a pivotally adjustable router bit is provided on the leading edges of the bowl to fracture the soil ahead of both sides of the cutting edge of the scraper to protect the bowl sides from excessive wear. The bits are pivotally mounted on the side walls of the bowl and are shaped in such a way that the leading edge of each bit wears uniformly as the bit is advanced from one secured position on the bowl to the next.

4 Claims, 2 Drawing Figures

EARTH SCRAPER WITH ROUTER BIT

BACKGROUND OF THE INVENTION

1. Field of the Invention

This invention relates to earthmoving scrapers and, more particularly, to a pivotally adjustable router bit for protecting the leading edges of the bowl of said scrapers.

2. Description of the Prior Art

In earthmoving scrapers, the leading edges of the bowl, on opposite sides of the cutter blade, are subjected to extreme wear due to the continual action of soil, rocks and the like, abrading away on said leading edges. The wear problem was recognized many years ago and various devices have been proposed for protecting the leading edges of the bowl by means of one or more router bits mounted on the bowl in a position to protect said leading edge.

Although the currently available router bits have provided protection for the leading edges of the bowl, they have been less than fully satisfactory in that they wear and have to be frequently replaced. The cost of the labor for replacing the bit, the cost of the replacement bit and the down time of the scraper, all contribute to the demand for an improved router bit.

SUMMARY OF THE INVENTION

A router bit on a scraper is pivotally mounted on the wall of the bowl in such a way that movement of the bit about the pivot axis moves the cutting edge of the bit into a position such that movement of the scraper causes the cutting edge of the bit to fracture the ground on either side of the cutter blade.

The router bit is provided with concentric arcs of apertures with one aperture in each arc lying on a straight line which line is offset from the pivot axis of the bit. A plurality of openings are formed in the wall of the bowl and lie on a straight line which is also offset from the pivot axis of the bit by an amount equal to said offset of the line of apertures in the bit. The line of openings in the wall are aligned with the lowermost line of apertures in the bit whereupon a plurality of fasteners are passed through the aligned apertures and openings for securing said bit in position on the wall. When the cutting edge of the bit has become worn, the fasteners are removed and the bit is rotated about the pivot axis until the next aligned row of apertures in the bit aligns with the openings in the wall. The bit is again secured in place by the fasteners whereupon the cutting edge of the bit is again extended for fracturing the soil on either side of the cutter blade.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
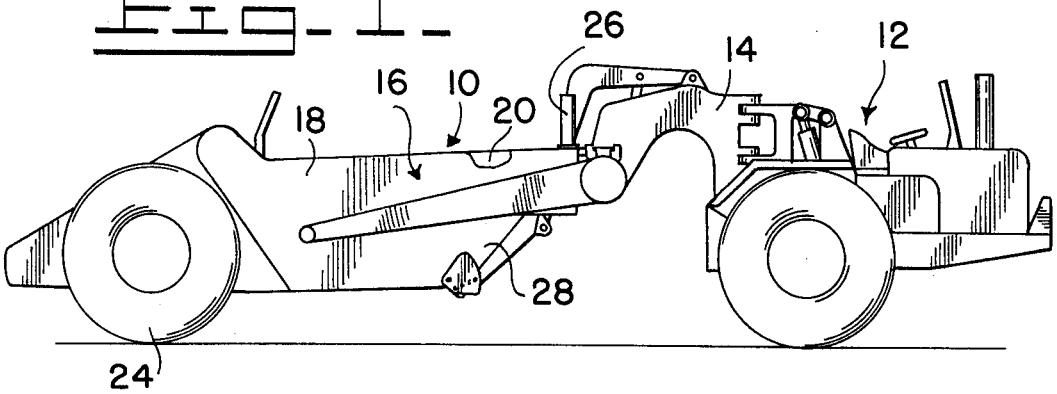
FIG. 1 is a side elevational view of an earthmoving scraper having the improved bit in position thereon; and, FIG. 2 is an enlarged partial view of that portion of the scraper bowl to which the improved pivotally adjusted bit is attached.

In FIG. 1 of the drawings, an earthmoving scraper 10 is illustrated and is shown connected to a tractor 12 by means of a gooseneck connection 14. The scraper 10 has a bowl 16 with a pair of vertically disposed spaced apart side walls 18,20 and a cutter blade 22 extending between said side walls 18,20. The scraper 10 is supported on rear wheels 24 and has an actuating mechanism 26 for raising and lowering the front portion 28 of the scraper 10 so as to move the cutter blade 22 into or out of soil scraping contact.

Figure 2:
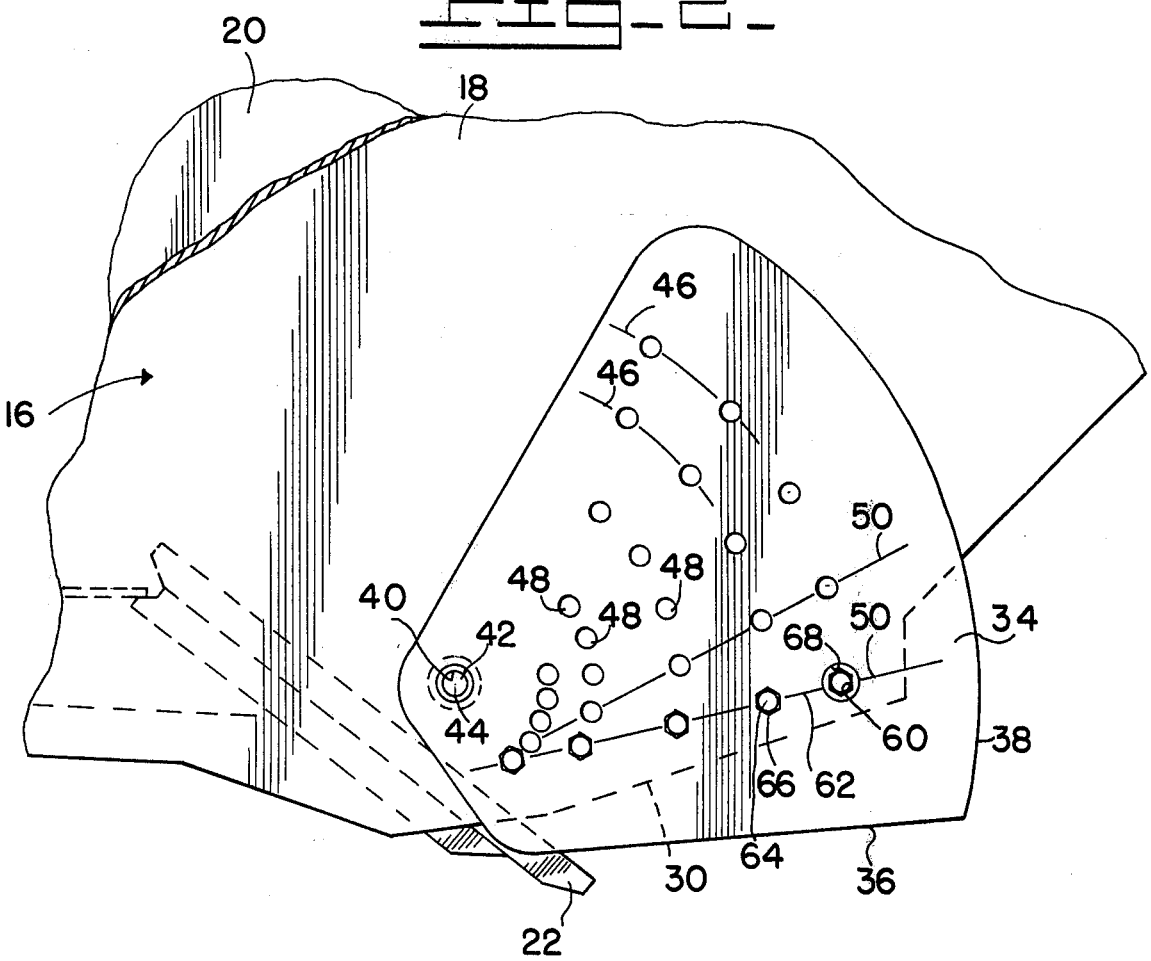

The side walls 18,20 have the lower and forwardly facing leading edges 30,32 exposed to the soil on each side of said cutter blade 22 such that pulling the scraper across a terrain with the cutter blade 22 engaging the soil will expose said leading edges 30,32 to great wear and misuse. a router bit 34 has been devised for use on each side wall 18,20 and, with one minor exception, is the same construction for use on each side. The router bit 34 is a somewhat truncated triangle in shape and has a lower cutting edge 36 and a forward cutting edge 38. The bit 34 has an opening 40 in one corner portion thereof which opening receives a pivot pin 42 anchored on the side wall 18 of the bowl 16. The bit 34 is free to rotate about the pivot axis 44 of the pin which rotation, when in a clockwise direction as viewed in FIG. 2, moves the cutting edges 36,38 into a more projecting exposed position beyond the leading edge 30 of the side wall.

The router bit 34 has a plurality of concentric arcs or segments of circles 46 subscribed about the axis 44 of the pivot pin 42 as a center. Each arc 46 has a plurality of apertures (five being illustrated) 48 disposed through said bit 34 with the center of each aperture 48 lying on the arc 46 on the circle. One aperture 48 in each arc 46 lies on a straight line 50, which line is drawn through the center of each said aperture 48. Each straight line 50 lies in the plane of the bit and is spaced from said pivot axis 44 a distance offset from said axis 44. It is to be noted that the straight line 50, passing through the lowermost line of apertures 48 through the bit 34, is almost parallel to the cutting edge 36 while at the same time the straight line 50 passes through the apertures 48, most removed from the cutting edge 36, forms an angle with the cutting edge 38 approaching a right angle. The reason for the rapid opening of the angle is to allow for the heavy and more extreme wear to which the junction of the cutting edges 36 and 38 are subjected. The wear diminishes along cutting edge 36 as the pivot end of the bit is approached. The cutting edge 38 wears away up to the overlap of the bit with the wall 18 just short of the leading edge 30 of said wall.

Each wall 18 and 20 have a plurality of openings 60 formed along a straight line 62 which line passes the pivot axis 44 of the pivot pin 42 a distance offset from said axis 44. The offset distance of the line 62 is the same offset distance by which the straight line 50 passes said axis 44 as described above. The line 62 of openings 60 lies generally close to the leading edge 30 of the wall 18 with each opening lying on an arc of one of several concentric circles which circles have a common center on the axis 44 of the pivot. The openings 60 are spaced from each other along the straight line 62 the same amount as the apertures 48 are spaced from each other along the straight line 50 on the bit 34 so that with one line 50 aligned with the line 62, all apertures 48 in that line in the bit 34 will align with corresponding openings 60 in the wall 18.

Fastening means, such as knock out pins or bolts 64, are passed through each aligned opening 60 and aperture 48 whereupon, in the case of bolts 64, nuts 66 are threaded thereon to lock the bit 34 to the wall 18. The apertures 48 in the bit 34 may be counterbored as at 68 so that the nuts 66 will be recessed therein out of the direct line of abuse from the soil and rock being worked by the scraper.

With the lowermost line 50 of apertures 48 aligned with openings 60 in the wall and with the nuts 66 and bolts 64 securing the bit to the wall, the cutting edges 36 and 38 of the bit will protect the leading edge 30 of the wall. As the scraper is used, the cutting edges 36,38 will be eroded and worn away to an extent where the edges 36,38 are close to the leading edge of the wall. At that time, the nuts 66 and bolts 64 will be removed and the bit 34 will be pivoted about the pivot pin 42 until the second line 50 of apertures 48 align with the openings 60 whereupon the bolts and nuts will be reinserted and tightened. The cutting edges 36,38 will, once again, be extended well beyond the leading edge 30 of the wall thereby providing protection for said leading edge. The process can be repeated as many times as there are lines 50 of apertures 48 in the bit 34 and, as illustrated, five separate pivoted resettings of the bit 34 are provided. Since the bit 34 can be reset each time sufficient wear has eroded away the cutting edges 36,38, it can be seen that substantially the whole bit 34 can be used up or expended before it must be removed and replaced thereby saving considerable material. In addition, since one pair of bits per scraper can be reset many times, it is not necessary to stock, on the site or in a warehouse, several sets of replacement bits as was the case heretofore. Stocking parts on a construction site is a real problem which can be somewhat alleviated by the improved pivotally adjustable bit.

The spacing between the apertures in single use bits, heretofore used, had very loose tolerances center-to-center. This resulted in some difficulty in aligning the apertures and openings with each replacement of a bit. With the improved pivoted bit, the tolerances between openings in each line of openings is relatively uniform so that once the first set of apertures is aligned with the openings in the wall, each successive alignment is the same thereby speeding up the resetting of the bit.

Although most of the description is directed toward one bit 34 on one wall 18, it is to be understood that the same description applies to a bit mounted on both walls 18 and 20. In the situation where no counterbores 68 are provided in one face of the bit 34, the bit 34 may be used on either side of the bowl so that one part serves the total requirement.

The material of the bit 34 can be selected from any one of the group of high-wear resistant materials. The pivot pin 42 is anchored in the wall of the bowl and generally presents a uniform diameter portion for engagement in the opening 40 in the bit 34. The pivot pin 42 may have means for threading a retainer on the outer end thereof or may be grooved to receive a snap fastener, both the retainer and the fastener being used to further hold the pivoted portion of the bit closer to the outside surface of the wall of the bowl.

What is claimed is:

1. In an earthmoving scraper having a bowl with a pair of spaced apart walls, a cutter blade extending between said walls and projecting forwardly for cutting a layer of soil, a router bit carried by one of said walls and having a cutting edge for fracturing the soil adjacent said cutter blade, means for pivotally mounting one end portion of said router bit on said wall, means for securing said router bit to said wall, means for repositioning said router bit to advance said cutting edge to accommodate for wear, said means for repositioning said router bit comprising a plurality of apertures through said bit with at least two of said apertures lying in a straight line offset from said means for pivotally mounting said bit and the wall of said bowl having at least two openings lying in a straight line which line is offset from the pivotal mounting of the bit an amount equal to the offset of the line of apertures, said aligned apertures aligning with said aligned openings and said means for securing said bit to said wall comprising fastening means passing through said apertures and said openings.

2. In an earthmoving scraper, a bowl having spaced apart side walls, a cutter blade extending between said side walls, a leading edge formed on each of said walls forwardly of said cutter blade, a router bit pivotally mounted on each of said side walls and having a cutting edge extending beyond the leading edge of said wall, a plurality of openings through each side wall and lying in a straight line offset from said pivot mounting for said bit, at least two groups of apertures formed through said bit, each group of apertures lying on a circle, the center of which coincides with the center of said pivot mounting, one aperture of each group lying on a straight line offset from said pivot mounting an amount equal to the offset of said straight line through the openings in the side wall, the apertures through the bit and lying on one straight line aligned with the openings in the wall lying on said straight line, and fastening means passing through said aligned apertures in the bit and openings in the side wall whereby as said cutting edge of said bit wears away, the bit is pivoted about the pivot mounting to rotate the bit and advance the cutting edge into a leading edge protecting position.

3. In the earthmoving scraper as claimed in claim 2 wherein said plurality of openings in said wall equal five in number and wherein each line of apertures in said bit have five apertures with the apertures in each line being alignable with the five openings in the wall.

4. In an earthmoving scraper, a bowl having a pair of spaced apart side walls, a cutter blade secured between said walls and projecting into a soil cutting relationship, a leading edge on each side wall in close proximity to said blade, a router bit, a pivot means passing through one portion of said router bit and being anchored in one of said walls for pivotally mounting said bit on said wall, said bit having a cutting edge projecting forwardly of said blade and of said leading edge of said side wall, at least two openings formed through said side wall and lying in a straight line which line is offset from and does not intersect the axis of the pivot means, a plurality of apertures through said bit, at least two of said apertures lying in a straight line which line is offset from said pivot means an amount equal to the offset of the line through the openings in the wall, at least two additional ones of said apertures lying along a straight line spaced from said first straight line, said first-named at least two apertures being aligned with said at least two openings in the wall, and fastening means passing through said aligned openings and apertures for securing said bit on said wall with the cutting edge in soil fracturing position, said fastening means being removable and said bit being pivoted so as to align the additional apertures with the openings in the wall, and said fastening means being reinserted in bit fixing relationship on said wall.

* * * * *